US008720388B2

(12) United States Patent
Beyerle et al.

(10) Patent No.: US 8,720,388 B2
(45) Date of Patent: May 13, 2014

(54) DEMAND MANAGEMENT FOR WATER HEATERS

(75) Inventors: Michael Thomas Beyerle, Louisville, KY (US); Michael Francis Finch, Louisville, KY (US); John Joseph Roetker, Louisville, KY (US); Natarajan Venkatakrishnan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 564 days.

(21) Appl. No.: 12/877,465

(22) Filed: Sep. 8, 2010

(65) Prior Publication Data

US 2012/0055419 A1 Mar. 8, 2012

(51) Int. Cl.
*F24D 3/08* (2006.01)

(52) U.S. Cl.
USPC ..... 122/20 B; 237/19

(58) Field of Classification Search
USPC ..... 122/20 B, 33; 237/19; 392/441, 454, 392/449
See application file for complete search history.

(56) References Cited

U.S. PATENT DOCUMENTS

| | | | | |
|---|---|---|---|---|
| 4,098,092 | A | 7/1978 | Singh | |
| 4,241,588 | A * | 12/1980 | Murphy et al. | 62/238.1 |
| 4,339,930 | A * | 7/1982 | Kirts | 62/235.1 |
| 4,498,622 | A * | 2/1985 | Harnish | 236/25 R |
| 5,115,491 | A | 5/1992 | Perlman et al. | |
| 5,544,645 | A * | 8/1996 | Armijo et al. | 126/101 |
| 5,701,387 | A | 12/1997 | McGugan | |
| 6,792,766 | B2 * | 9/2004 | Osborne et al. | 62/159 |
| 8,175,752 | B2 * | 5/2012 | Deivasigamani et al. | 700/275 |
| 2009/0064944 | A1 * | 3/2009 | Paine | 122/14.22 |
| 2009/0314464 | A1 * | 12/2009 | Farrell | 165/57 |

FOREIGN PATENT DOCUMENTS

| | | |
|---|---|---|
| DE | 38 28 396 A1 | 3/1989 |
| GB | 970 327 A | 9/1967 |

OTHER PUBLICATIONS

U.S. Appl. No. 12/623,753, filed Nov. 23, 2009, Roetker.
European Search Report issued in connection with 11181825.8, Dec. 22, 2011.

* cited by examiner

*Primary Examiner* — Gregory A Wilson
(74) *Attorney, Agent, or Firm* — Global Patent Operation; Marc A. Vivenzio

(57) ABSTRACT

A water heating control and storage system, including an insulated tank for containing water to be heated. The storage system has a heat exchanger connected to the tank for using energy stored during off peak times as in water heated above normal storage temperature. An operation control device receives a demand response signal and enables water to be heated in a heat storing mode to heat water for usage. A method for controlling a water heating storage system includes providing an insulated tank for containing water to be heated; providing a heat exchanger coupled to the tank; and selectively operating in a heat storing mode in which water in the tank is heated to a higher than normal temperature and a heat exchange mode during which heat is extracted from the water stored in the tank by a heat exchanger for supplying stored energy to another energy consuming load in response to a demand response signal.

14 Claims, 5 Drawing Sheets

DEMAND MANAGEMENT FOR WATER HEATERS

CROSS-REFERENCE TO RELATED PATENT AND APPLICATIONS

The following is a commonly assigned co-pending application, the disclosure of which is incorporated herein by reference in its entirety:

U.S. application Ser. No. 12/623,753, filed Nov. 23, 2009, entitled WATER HEATING CONTROL AND STORAGE SYSTEM.

BACKGROUND

The present disclosure relates generally to managing water heater systems. More particularly, it relates to managing and controlling water heater systems in a manner responsive to varying energy demand periods.

Water heater storage tanks are used for storing and supplying hot water to households. A typical residential water heater holds about fifty gallons (190 liters) of water inside a steel reservoir tank. A thermostat is used to control the temperature of the water inside the tank. Many water heaters permit a consumer to set the thermostat to a temperature between 90 and 150 degrees Fahrenheit (F) (32 to 65 degrees Celsius (C)). To prevent scalding and to save energy, most consumers set thermostat to heat the reservoir water to a temperature in a range between 120.0 degrees F. to 140.0 degrees F. (about forty-nine degrees C. to sixty degrees C.).

A water heater typically delivers hot water according to the thermostat temperature setting. As a consumer draws water from the water heater, the water temperature in the water heater usually drops. Any time the thermostat senses that the temperature of the water inside the tank drops too far below thermostat's set point, power is sent to the electric resistance heating element (or a burner in a gas water heater). The electric elements then draw energy to heat the water inside the tank to a preset temperature level.

In some locations of the United States and globally, the cost for electrical energy can vary as a function of the time of day, day of the week and season of the year. In areas of the United States where energy is at a premium, utility companies often divide their time of use rates into off-peak and on-peak energy demand periods with a significant rate difference between the periods. For example, energy used during off-peak hours may cost the consumer in United States dollars around 5 cents to 6 cents per kilowatt hour (kWh), while on-peak period energy may cost anywhere from 20 cents per kWh to $1.20 or more per kWh.

A water heater that heats based on the water demand of a typical household is likely to heat at the same time as when energy demand on a utility company is at its highest. As a result, drawing energy to heat a water heater during these on-peak energy periods increases a consumer's monthly energy bill. The disclosure seeks to provide a means to avoid on peak energy use, saving the consumer operating expense, while supplying a continuous supply of domestic hot water utilizing conventional and possibly existing electric water heating systems.

One approach to negotiate the utility companies' time of use energy rates would be to use a programmable timer to turn off the entire water heater or the lower element. For example, a clock timer could be used to provide planned heating periods during known off peak periods of the day. While this approach is possible, adapting to period variation in the rate schedule and emergency load shedding request signals from the utility are not accommodated.

Simply increasing the storage size of the tank and/or increasing the set temperature of the tank in combination with use of a thermostatic mixing valve at the hot water outlet, serves to increase the hot water capacity, but it does not alter the energy consumption pattern of the water heating system. The lower heating element will also need to be disengaged in order to avoid consumption during "on peak" energy rate hot water usage.

Set point alteration is another means to reduce heating events during on peak water usage. While this will produce a similar outcome as disengagement of the heating elements, it requires a substantially different control mechanism for regulation and limiting of the tank temperature and cannot be easily retrofit to an existing water heating system.

Another approach is simply shutting the entire water heater off during on peak energy periods. This could result in the consumer running out of hot water during peak hours and left to wait until off peak hours to resume heating the entire stored water volume of the tank, meeting demand. This approach requires consumer behavior change or purchase and installation of a larger storage tank size to bridge the peak hour water usage. This results in an investment requirement from the consumer and presumes the availability of space to install a larger tank. Commonly, space limitation prevents installation of a water heater large enough to meet the storage meets to bridge the peak hours.

A non-replenishing tank could be used to maintain heated temperatures during "on peak" hours and be refilled and heated only during off peak hours. However, this approach requires an open tank or a means to compensate for pressure and volume changes.

Copending U.S. application Ser. No. 12/623,753 describes a system which provides a continuous supply of domestic hot water to meet the needs of a consumer, while utilizing off peak hours for heating of the stored water. Such a system also provides a valuable mechanism for a utility to shed load during peak and critical power demand periods. Another aspect of said application is that the upper and lower heating elements can be enabled/disabled independently based on the demand response signal level. Still another aspect of the disclosure is the heating operation corresponding to the demand response level is consumer selectable for multiple tier signals (which may be greater than four levels). During low energy rate conditions, the lower element is engaged to heat the contents of the full tank for future use during high energy rate periods. The lower element is then disengaged during high energy rate periods according to the programmed schedule, or an external or consumer input, reducing energy consumption during high energy rate periods. A limitation of this system is that the stored energy can only be used for hot water. If the consumer is away, or not using water that stored, energy is essentially wasted.

Thus there is a need for a system that can remove excess energy from the hot water heater when energy rates are high and store additional energy when electric rates are low.

SUMMARY

A water heating and storage system includes an insulated tank with an upper and lower heating element which may be resistive heating or a heat pump, each with independent temperature regulating and limiting capability and a control device for operating each element independently. The water heater could also be fired by natural gas or propane if in the future the cost of those varied over time. The control is configured to provide heating input during low energy rate or usage conditions to minimize operating cost. The signal for the control indicative of the energy rate or usage condition can be either generated in accordance with a programmed time schedule, or an external input signal from the utility or energy provider indicating a change in energy cost rate or from the consumer/owner. The water heater is provided with a thermostatic control valve to provide consistent output temperatures.

A plumbing connection is also provided to allow hot water from the tank to be diverted to a heat exchanger before going through the thermostatic valve. This may be accomplished by removing the water from the hot water tank and sending it to the heat exchanger and returning it to the tank, or providing plumbing connections to remove the water from the tank and storing it in a new tank, and using a mixing valve to fill the new tank to a desired temperature. This allows heat transfer from the tank without mixing the fluids.

The water is heated up to the maximum temperature allowed by the tank construction. Typically 170-180 F for a standard water heater, but the methods for operating at higher temperatures and pressure are well documented in the boiler industry. A thermostatic mixing valve is used at the hot discharge of the storage tank to reduce the temperature of the water delivered to the user, reducing scalding risk and effectively increasing the thermal energy storage capacity of the system.

In one embodiment, a water heating control and storage system comprises a first insulated tank for holding water to be heated and a second insulated tank for holding water to be heated. A first plumbing connection is coupled to the first and the second tank, and configured to enable a first flow of water heated to a storage temperature greater than approximately 150 degrees F. from the first tank towards the second tank. A heat exchanger operatively selectively coupled in a parallel in heat exchange relationship with the water in connection to the first and the second insulated tank for transferring heat from a first flow of water that is heated to another medium. The system also comprises an operation control device configured to receive and process a demand response signal and operate the first tank in at least one of a plurality of operating modes, including at least a water heating mode and a heat exchange mode.

These and other aspects of the present disclosure will become apparent upon a reading of the detail description and a review of the accompanying drawings.

DETAILED DESCRIPTION

Figure 1:
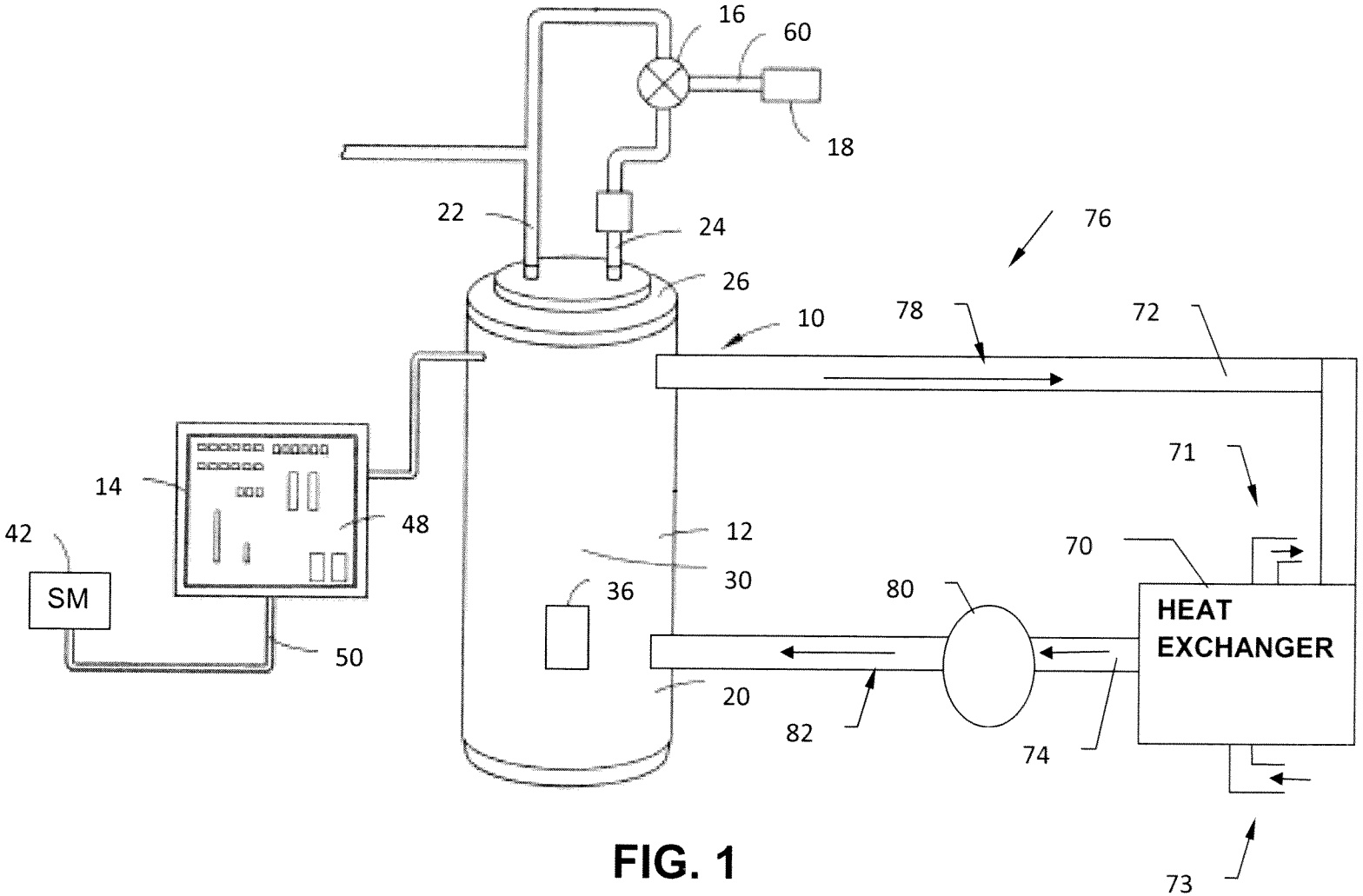
FIG. 1 is an isometric view of a water heater system in accordance with an illustrative embodiment of the present disclosure.

Referring to FIG. 1, a water heating control and storage system 10 in accordance with an exemplary embodiment of the present disclosure is illustrated. The water heater system 10 includes a water heater 12, a control panel 14, a mixing valve 16, and a cutoff valve 18.

The water heater has a heater and a tank to store heated water. The water heater includes a shell 20, a "cold in" pipe 22, a "hot out" pipe 24, and a cover 26. The casing surrounds a tank 30 that acts as an interior reservoir for water. Insulation is provided around the exterior of the tank to reduce heat transfer. For typical domestic household use, the tank is preferably 80-gallon capacity or more. The cold in pipe delivers water to the water heater at a temperature typically 40 to 80 degrees F. (4 to 27 degrees C.). The hot out pipe conventionally delivers water away from the water heater at a temperature of about 120 degrees F. (about 49 degrees C.). The cover and base seals the shell providing an enclosure for the tank, insulation and wiring system.

The water heater control and storage system 10 of FIG. 1 further comprises a heat exchanger 70 that is operatively selectively coupled in heat exchange relationship with the water in tank 30. In the embodiment of FIG. 1, heat exchanger 70 is connected to the water heater 12 via a closed loop 76. The close loop 76 includes the storage tank 30 connected to the heat exchanger 70 with a first plumbing connection 72 and a second plumbing connection 74. The heat exchanger 70 is provided for extracting energy from the water in tank 30 in accordance with an exemplary embodiment of the disclosure.

The heat exchanger 70 is configured for efficient heat transfer from a first medium comprising water to another medium, which can be water, another different fluid, air, or metal, for example. The media may be separated by a wall (not shown) or in direct physical contact in some cases. The heat exchanger 70 is used in any setting (e.g., industry, home use, etc.) both for cooling and/or heating. The type and size of the heat exchanger used can be tailored to suit a process depending on the type of fluid, its phase, temperature, density, viscosity, pressures, chemical composition and various other thermodynamic properties.

To take advantage of low cost electricity during an off peak operating state of an energy provider, the water heating system 10 heats the water in the storage tank to an above normal temperature, e.g., above a temperature of about 150 degrees F. Thus electric energy provided during the off peak lower rate period is stored in the form of heat energy in water heated above normal storage temperature (e.g., water above 150 degrees F.). During periods of time when electricity is more expensive, the water heating system 10 can be operated in an energy saving mode which would include the heat exchange mode to transfer energy in the stored water heated above normal storage temperature to another medium to provide energy for the other device or function served by the heat exchanger at a lower cost, which is provided by the DR signals or TOU rates sent by the utility and received at the system further discussed below. For example, if the heat exchanger 70 is configured to function as source of heat for a radiator or a forced air unit, heat in the form of water heated above normal storage temperature is transferred from tank 30 to the air for heating a dwelling or building. In another example, the heat is used in HVAC coils for air conditioning. Liquid-to-air or air-to-liquid HVAC coils are of a modified cross flow arrangement. On the liquid side of these types of heat exchangers, the fluids are water, a water-glycol solution, steam or a refrigerant, for example. The present disclosure is not limited to any one type of medium, or is the disclosure limited to any one type of heat exchanger for making use of energy stored in the system 10.

In another embodiment, the heat exchanger 70 is a thermoelectric generator or a turbine, for example, for converting heat stored in the water heated above normal storage temperature to electricity. Thermoelectric generators are devices which convert heat differentials (e.g., heat gradients) directly into electrical energy. A principal of operation is based on the thermoelectric effect, which is the direct conversion of temperature differences to electric voltage and vice versa. A thermoelectric device creates a voltage when there is a different temperature on each side of junction within a close loop, for example. Conversely when a voltage is applied to it, a temperature difference is created (known as the Peltier effect). At atomic scale (specifically, charge carriers), an applied temperature gradient causes charged carriers in the material, whether they are electrons or electron holes, to diffuse from the hot side to the cold side, similar to a classical gas that expands when heated; hence, the thermally-induced current. This effect can be used to generate electricity, to measure temperature, to cool objects, or to heat them or cook them. Because the direction of heating and cooling is determined by the sign of the applied voltage, thermoelectric devices can make good temperature controllers.

Referring again to FIG. 1, the first plumbing connection 72 comprises a hot water connection for providing a first flow 78 of water heated above normal storage temperature to heat exchanger 70 to transfer heat from the water to another medium within the heat exchanger. Pressure within the system 10 is substantially constant. Therefore, the system 10 includes a pump 80 to selectively create the first flow 78 into the heat exchanger 70 and a second flow 82 that returns water back to the tank 30. When the system is operating in the normal water heating mode, pump 80 is not energized and the water is simply maintained at the prevailing set point temperature. For example, during low rate off peak states, the set point temperature may be set for the heat storage mode during which the water is heated to the higher than normal temperature set point, preferably a temperature set point greater than 150 degrees F. When operating in the energy saving mode, such as during a peak or high rate utility state, the water heater set point may be adjusted to heat the water to a more typical or normal temperature on the order of 120 degrees F. When in the energy saving mode, the system may also operate in the heat exchange mode by energizing pump 80 to circulate hot water from the storage tank through the heat exchanger 70. During circulation in the heat exchange mode, cooler water in the second flow 82 returns to the bottom of the tank in order to keep the water temperature stratified with the hot water at the top and cooler water at the bottom of the tank 30. Thus, the first flow 78 of water comprises water of a higher temperature than the second flow 82 of water returning to the tank 30. This difference in temperature results from the heat from the stored water being extracted as it moves through the heat exchanger and transferred to the other medium, which flows through the heat exchanger via connections 71 and 73. For example, connections 71 and 73 may be conducting air to be heated for a forced air heating system, in which case, air is heated by the water heated above normal storage temperature and used as hot air to heat the system.

Figure 2:
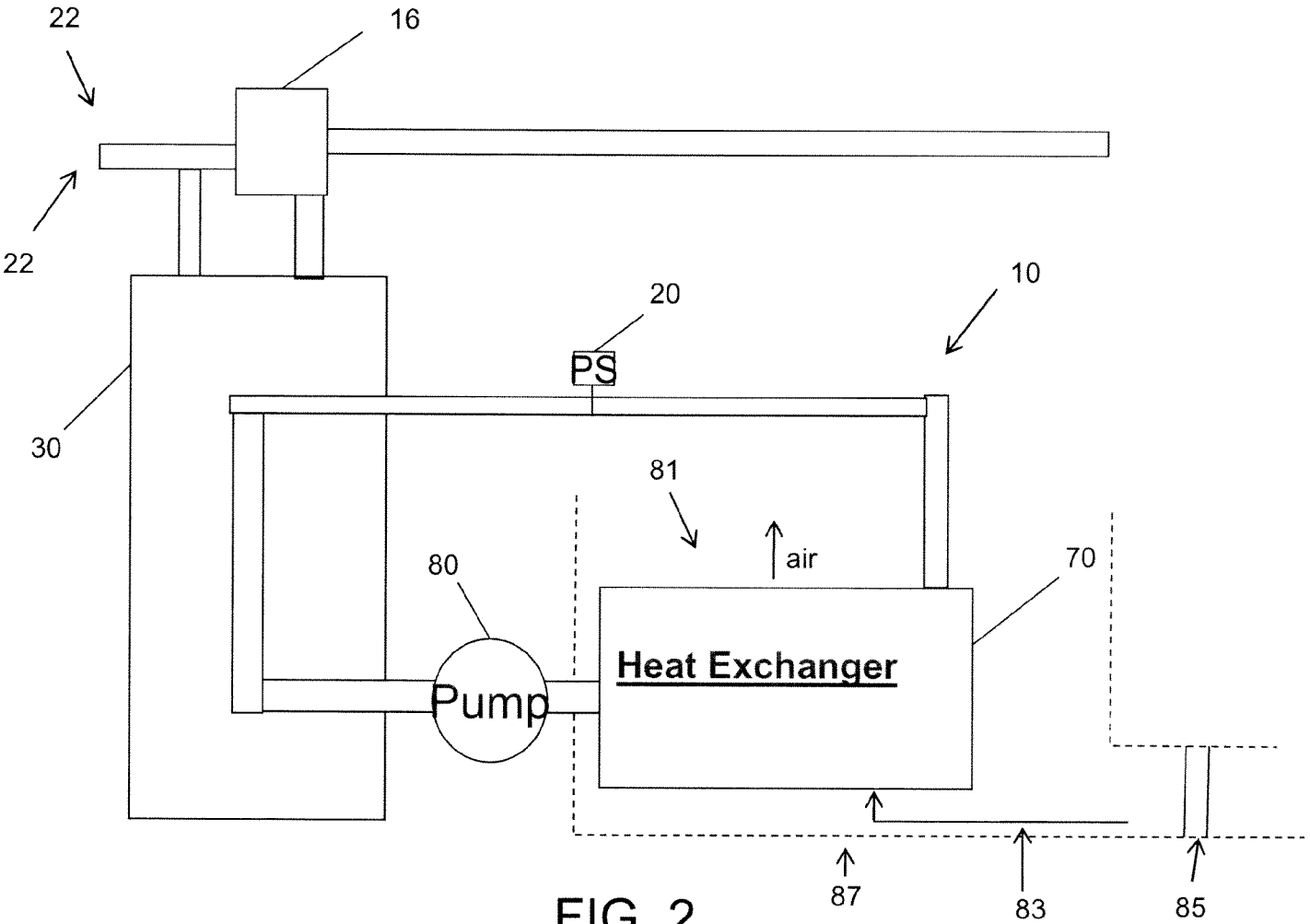
FIG. 2 is an isometric view of a water heater system in accordance with an illustrative embodiment of the present disclosure.

In another exemplary embodiment illustrated in FIG. 2, water is not diverted from the water tank to the heat exchanger, but rather kept within the water tank (FIG. 2). In this example, a low pressure loop is provided with a pressure sensor for determining a change in pressure in the case of any leakage occurring. The loop comprises the heat exchanger 70 and the pump 80, as discussed supra. The loop is a closed loop that could comprise a glycol fluid or other fluid that is not harmful if leaked out. The fluid is in heat exchange relationship with the water in the tank and with heat exchanger 70. Hot water (e.g., water heated above normal storage temperature) in the tank is therefore used to heat the fluid in the loop for the heat exchanger 70. An air chamber or plenum 87 encloses heat exchanger 70. Air enters the plenum through filter 85 and flows over the heat exchanger absorbing heat from the fluid flowing in loop. The heated air exits at 81 into the environment being heated.

Hot water service is typically provided at 120 degrees F., therefore the thermostatic mixing valve setting is about 120 degrees F. Typical element settings are in a range from 120 degrees F. to 140 degrees F. for a conventional water heater. When a water heater is being configured to perform under a demand response approach as described in this disclosure, the energy storage capacity of a water heater can be maximized by elevating the element setting to a maximum level greater than the normal setting, and preferably greater than about 150 degrees F. for heating water in the tank in a heat storing mode of operation.

Referring back to FIG. 1, when the water heater is supplied power directly, a thermostat 36 can provide sole control over the flow of energy to the heating elements to maintain a predetermined substantially stable temperature in the tank. If the thermostat provides the only control over the flow of energy to the water heater, then the water heater may operate during on-peak energy periods. To provide more control over the operation of the heating elements, the water heater system includes the demand response control panel which is configured to disable or prevent or otherwise control energization of the water heater elements in response to the rate or energy usage condition information.

The water heater system further includes mixing valve 16 connected to a cold in pipe 22 and the hot out pipe 24. The temperature of the water in the cold in pipe is about 40 degrees F. to 80 degrees F. (about four degrees C. to twenty-seven degrees C.).

On receiving cold water from the cold in pipe and hot water from the hot out pipe 24, the mixing valve 16 is configured to combine the two different temperature waters into mixed water having a temperature selected by the user by adjusting the temperature set point for the mixing valve. For example, the user typically selects a set point in the 110-120 degrees F. range and in response water from the mixing valve outputs into a service pipe 60 at approximately the set point temperature.

The cutoff valve 18 is provided as a safety backup to the mixing valve. In other words, the cutoff valve is a thermostat-controlled safety device that automatically closes if the water in the service pipe 60 reaches a predetermined high temperature, such as about 160.0 degrees F. (about seventy-one degrees C.).

Through an interface of the control panel 14, a consumer inputs the preferred response to the tiered signal levels from the energy provider and/or the programmed daily off-peak/on-peak demand periods scheduled into a timer. The signal line also delivers this information into the control panel from, for example, utility companies.

The control panel 14 includes a demand response (DR) control 48 which in turn is connected to a transceiver, which is connected directly or indirectly to a source of utility rate information such as for example, a "smart" utility meter 42. A power connection is provided to the water heater system. The water tank, as well as the control panel is provided power from this connection. The control panel serves to enable control of power to the water heater and pump 80 to operate the system in the normal mode and the energy saving mode, including the heat exchange mode, based on a communication signal to an interfaced port.

The demand response control 48 communicates via a signal line 50 from an energy provider, via a transceiver or hard line connection. The signal line communicates status information such as the response level regarding off-peak and on-peak information from energy generating facilities. The demand response control can be configured to receive and process a signal indicative of a current state of a utility or energy provider. The utility state has an associated energy cost.

The demand response control is configured to override the normal operating mode of the water heater based on the operating state of the utility to reduce energy consumption during peak usage states thereby lowering the energy cost for the user. A manual override for a user can be provided to override the demand response signal if desired. As one example, the control may be configured to operate the water heater system in an energy savings mode when the utility is operating in a peak state. Alternatively, the user may select a target or threshold energy cost. If a current energy cost indicated by the utility state signal, exceeds the user selected cost, the water heater system is operated in an energy saving mode. If the utility is operating in an off-peak mode, or current energy cost is less than the user selected cost, the operation control device operates the water heater system in a normal operating mode. When operating in the normal operating mode, the water heater is enabled operate in a heat storing mode to heat the water to a higher than no, trial temperature, e.g., a predetermined temperature in excess of 150 degrees F., taking advantage of low cost energy being provided by heating the water above normal storage temperature in the tank. This energy is then used during operation in the heat exchange mode for reducing energy cost during peak times when energy cost is higher.

The DR control acts as a radio receiver or has a remote transceiver, which could receive a multiple tiered response level signal, directly or indirectly from the utility for example. A multi leveled response is operable for triggering an "on peak" response. For example, the control has a cost control that processes at least one signal having an associated energy cost. The control enables operation of the heat exchanger 70 in the heat exchange mode when the energy cost associated with the signal is high. Thus, the heat exchanger 70 operates to save cost when costs are high. Likewise, when the energy cost is lower, then the tank operates in a heat storing mode to heat water above normal storage temperature for storing.

Figure 3:
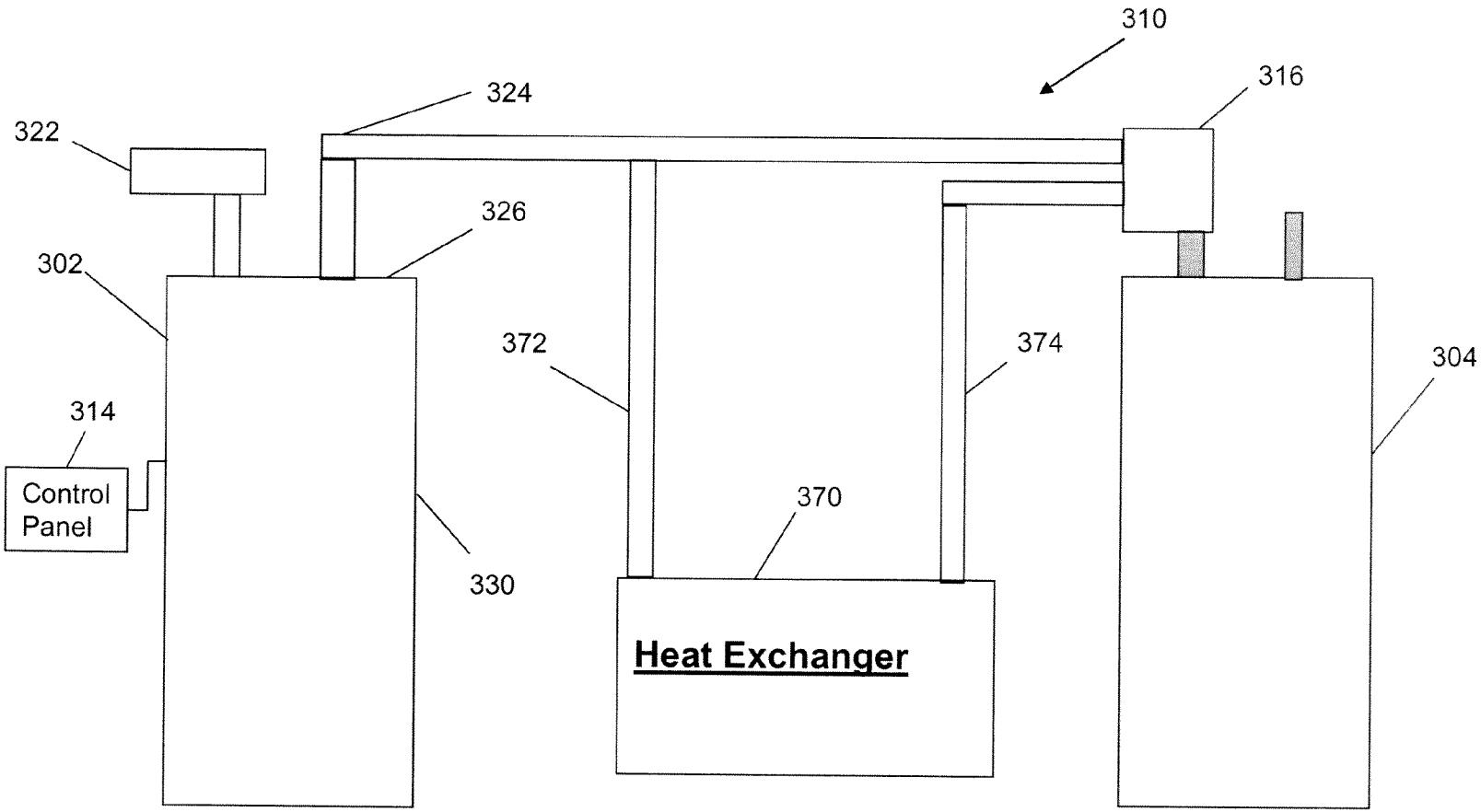
FIG. 3 is an isometric view of a water heater system in accordance with an illustrative embodiment of the present disclosure.

Referring now to FIG. 3, a water heating control and storage system 310 in accordance with another exemplary embodiment of the present disclosure is illustrated. The water heater system 310 includes a first water heater 302, a second water heater 304, an operation control 314, a mixing valve 316, and a heat exchanger 370.

The first water heater 302 has a "cold in" pipe 322, a "hot out" pipe 324, and a cover 326. The casing surrounds a tank 330 that acts as an interior reservoir for water. Insulation is provided around the exterior of the tank to reduce heat transfer. The cold in pipe 322 delivers water to the first water heater 302 at a temperature typically in the range of 40 to 80 degrees F. (4 to 27 degrees C.). The hot out pipe conventionally in a water heating mode delivers water away from the water heater at a temperature of about 120 degrees F. (about 49 degrees C.). However, since the first water heater 302 is used as a means for storing water heated above normal storage temperature, the "hot out" pipe 324 delivers water heated above normal storage temperature at a temperature above about 150 degrees F. to the second water tank 304. The mixing valve 316 intercepts the water heated above normal storage temperature flow and mixes cooler water directed to it from the heat exchanger 370 via a second plumbing connection 374. Consequently, water entering the second water heater 304 is cooler at a more standard temperature of about 120 degrees F.

The water heater control and storage system 310 of FIG. 3 further comprises a first plumbing connection 372 connecting the heat exchanger 370 to the "hot out" pipe 324. Water heated above normal storage temperature is supplied to the heat exchanger 370 via the first plumbing connection 372.

The first water heater 302 in conjunction with the second water heater 304 increases the water storage capacity of the system. The second water heater 304 is maintained at a standard water temperature, while the first water heater 302 maintains the water stored at a heat storing mode level for providing energy with the heat exchanger 370.

The water in the first tank 302 is heated when energy is provided at a relatively reduced cost with respect to different cost levels. The operation control 314 is configured as a demand response control that acts as a radio receiver or has a remote transceiver, which could receive a multiple tiered response level signal, for example. As discussed above, a multi leveled response is operable for triggering an "on peak" response. The control 314 operates the heat exchanger 370 in the heat exchange mode to transfer the energy stored in the hot water to another medium to supplement the energy needed by another device when the energy cost associated with the signal is relatively high.

Figure 4:
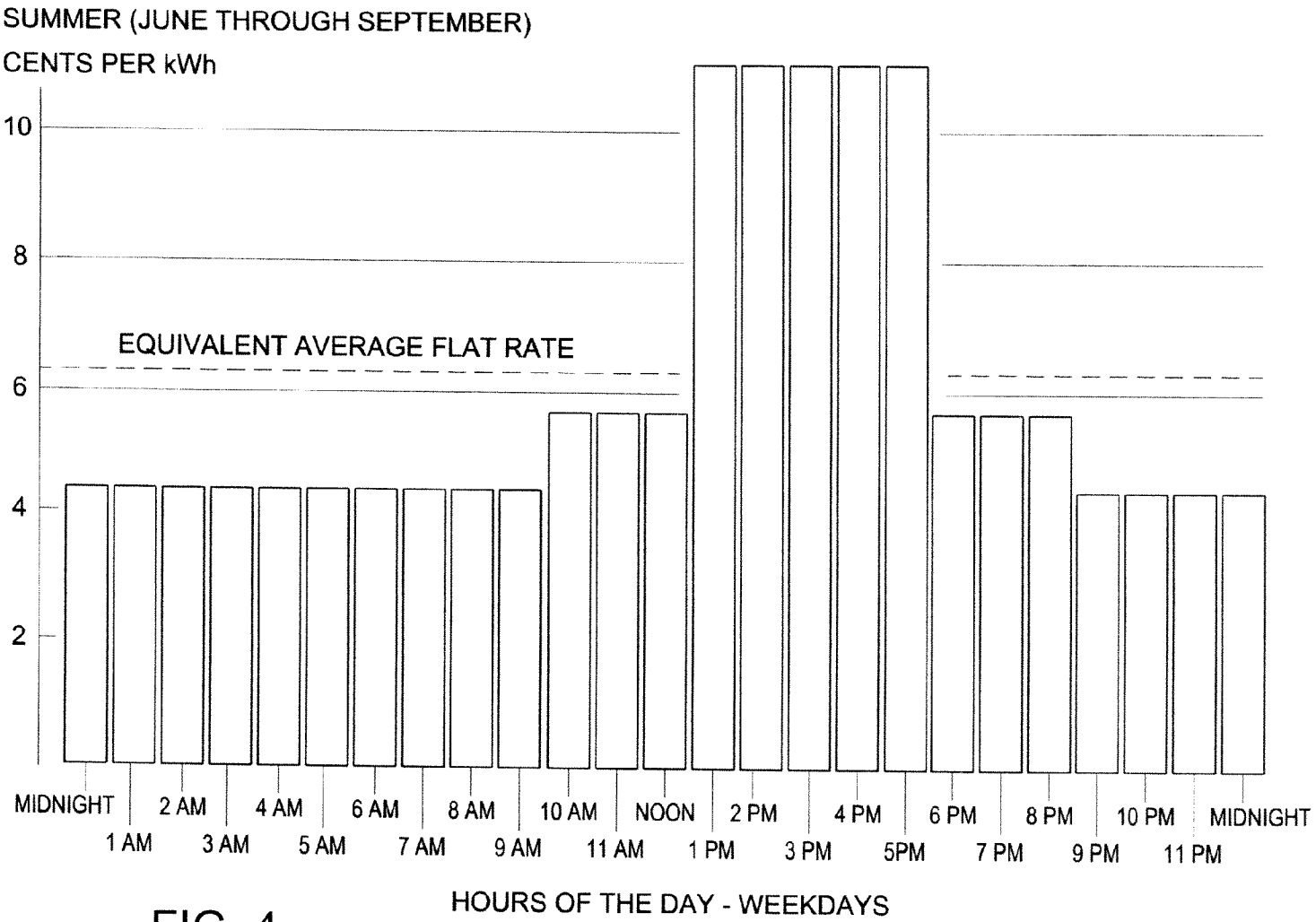
FIG. 4 illustrates a utility time of use rates for a summer season.
Figure 5:
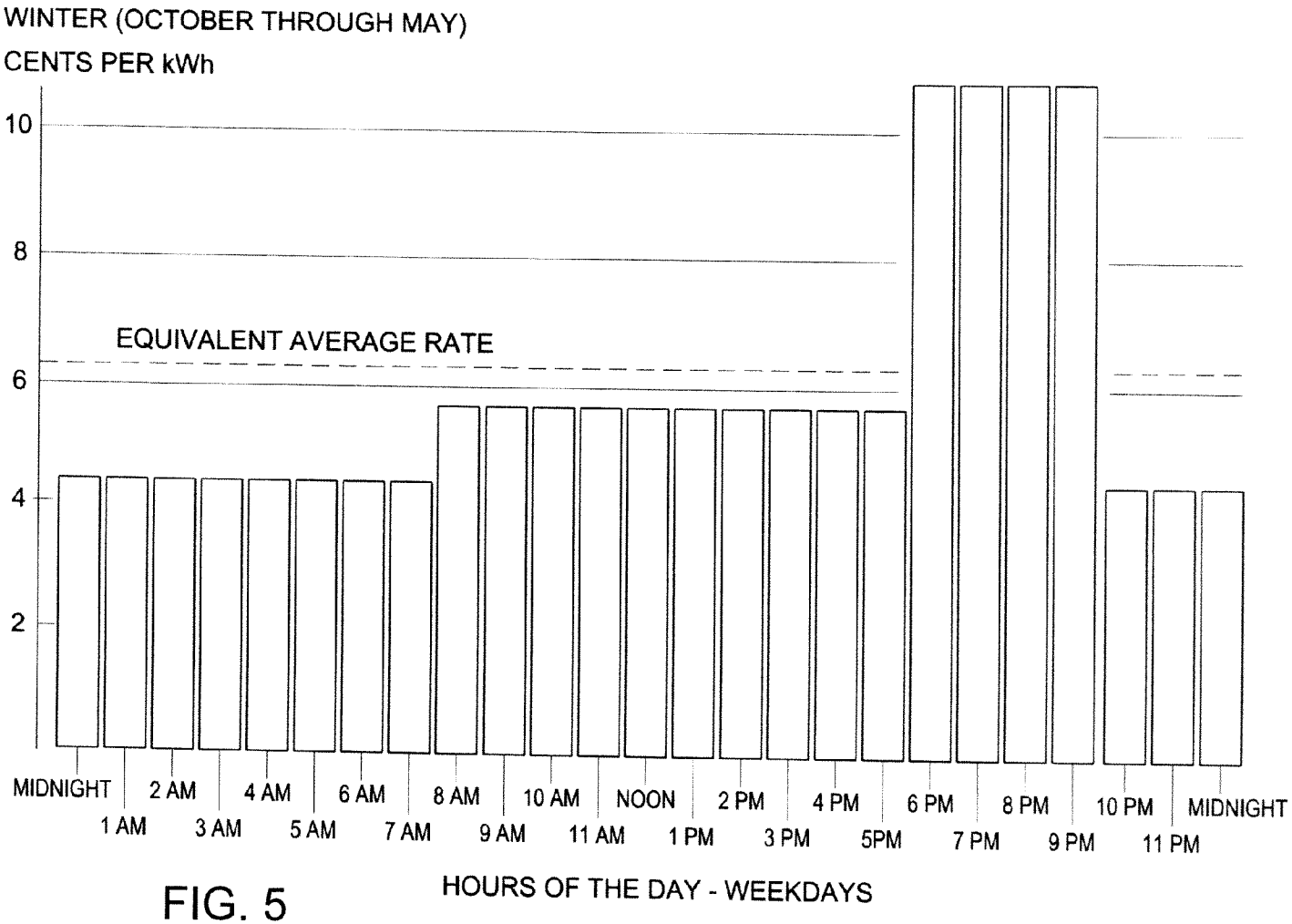
FIG. 5 illustrates a utility time of use rates for a winter season.

FIGS. 4 and 5 illustrate examples of a utility's time of use rates for a summer season and winter season, respectively. The peaks mostly follow residential heating and cooling load and appliance (including water heating) consumer usage patterns. For example, rates peak between 1:00 p.m. and 5:00 p.m. in the summer and between 6:00 p.m. and 9:00 p.m. in the winter. Of particular importance is a winter peak of 6-9 pm. These are examples of a specific utility, and they can vary significantly. Especially in the southeastern United States, on winter mornings there is high electrical demand from hot water for bathing, cooking, and heating the home, which can lead to peak rates in the early AM, or even two peak rate periods a day.

The disclosure has been described with reference to the preferred embodiments. Obviously, modifications and alterations will occur to others upon reading and understanding the preceding detailed description. It is intended that the invention be construed as including all such modifications and alterations.

What is claimed is:

1. A water heating control and storage system, comprising:

an insulated tank for holding water to be heated to a storage temperature greater than approximately 150 degrees F.;

a heat exchanger operatively selectively coupled in heat exchange relationship with the water in the insulated tank by a first plumbing connection for transferring heat from a first flow of the water heated in the tank to another medium; and an operation control device configured to (i) receive and process a demand response signal and to operate the system in at least one of a plurality of operating modes, including at least a water heating mode and a heat exchange mode, and (ii) selectively operate the system in the heat exchange mode and the water heating mode and comprises a control to process at least one signal that indicates an energy usage state from a plurality of energy usage states of an energy provider including at least a peak state and an off peak state;

wherein the operation control devices operates the heat exchange mode when the energy usage state and associated cost is the peak state.

2. The system of claim 1, further comprising a second plumbing connection coupled to the heat exchanger and the tank that is configured with a second flow of water to return to the tank from the heat exchanger, the second flow having a cooler water flow than the first flow.

3. The system of claim 2, wherein the tank comprises an upper section and a lower section and the second plumbing connection is coupled from the heat exchanger to the lower section to form a closed loop that allows the flow of water to return from the heat exchanger to the tank and maintain a substantially stable water temperature within the tank.

4. The system of claim 1, wherein the first plumbing connection is configured to divert water that is heated from the tank to the heat exchanger where energy is transferred from heat stored in the water of the tank to the another medium comprising air, electricity, water or a different fluid.

5. The system of claim 1, wherein the tank comprises an upper section and a lower section, and the first plumbing connection is coupled to the upper section of the tank to allow the flow of water to be directed from the tank to the heat exchanger and to maintain a substantially stable water temperature within the tank.

6. The system of claim 1, wherein the heat exchanger comprises a radiator or forced air unit configured to transfer heat from the tank to the another medium comprising air for heating a dwelling place.

7. The water heating control and storage system of claim 1, wherein the operation control device comprises a manual override to override the device, and the operation control device is connected to a signal line in communication with a home energy manger device or an energy metering device in communication with an energy provider.

8. A water heating control and storage system, comprising:

a first insulated tank for holding water to be heated;

a second insulated tank for holding water to be heated;

a first plumbing connection coupled to the first and the second tank, and configured to enable a first flow of water heated to a storage temperature greater than approximately 150 degrees F. from the first tank towards the second tank;

a heat exchanger operatively selectively coupled in a parallel in heat exchange relationship with the water in connection to the first and the second insulated tank for transferring heat from a first flow of water that is heated to another medium; and an operation control device configured to receive and process a demand response signal and operate the first tank in at least one of a plurality of operating modes, including at least a water heating mode and a heat exchange mode.

9. The water heating control and storage system of claim 8, further comprising:

a second plumbing connection coupled to the first plumbing connection and the heat exchanger configured for a second flow of water heated above normal storage temperature from the first tank to the heat exchanger; and a third plumbing connection coupled to the second tank and the heat exchanger for enabling a third flow of water from the heat exchange to the second tank, wherein the third flow of water comprises cooler water than the first and the second flow of water.

10. The water heating and storage system of claim 8, further comprising:

a thermostatic mixing valve coupled to the second tank for receiving the first flow of water heated above normal storage temperature and configured to mix cooler water from the heat exchanger to provide a desired mix of water heated above normal storage temperature and cooler water temperature to enter the second tank.

11. The water heating control and storage system of claim 8, wherein the water is stored at a temperature in the range of a lower level or about 90 degrees F. to an upper level or about 150 degrees F. in the second tank in the water heating mode, and the water heated above normal storage temperature in the first tank is stored at a temperature greater than about 150 degrees F. in the heat exchange mode.

12. The water heating control and storage system of claim 8, wherein the operation control device is further configured to operate the heat exchanger and to receive and process at least one of a plurality of signals respectively indicative of an associated energy cost of an associated utility.

13. The water heating control and storage system of claim 12, the operation control device is further configured to switch to heat exchange mode of the first tank based on the at least one signal received with the associated energy cost being lower than at least one other associated energy cost in order to cost effectively store heat in the water of the tank and operate the heat exchanger of the system.

14. A water heating control and storage system, comprising:

an insulated tank for holding water to be heated to a storage temperature greater than approximately 150 degrees F.;

a heat exchanger operatively selectively coupled in heat exchange relationship with the water in the insulated tank by a first plumbing connection for transferring heat from a first flow of the water heated in the tank to another medium; and an operation control device configured to receive and process a demand response signal and to operate the system in at least one of a plurality of operating modes, including at least a water heating mode and a heat exchange mode;

wherein (i) the heat exchanger comprises a turbine or thermoelectric generator configured to generate electricity from a temperature difference of the first flow of water that is heated and the another medium causing an electric current, or (ii) the water is stored in the water heating mode at a temperature in the range of a lower level or about 90 degrees F. to an upper level or about 150 degrees F., and when operating in the heat exchange mode water is stored at a temperature greater than about 150 degrees F.

* * * * *

UNITED STATES PATENT AND TRADEMARK OFFICE

CERTIFICATE OF CORRECTION

PATENT NO. : 8,720,388 B2
APPLICATION NO. : 12/877465
DATED : May 13, 2014
INVENTOR(S) : Beyerle et al.

It is certified that error appears in the above-identified patent and that said Letters Patent is hereby corrected as shown below:

In the Specification

In Column 1, Line 28, delete “set” and insert -- set the --, therefor.

In Column 4, Line 62, delete “or” and insert -- nor --, therefor.

In Column 7, Line 26, delete “no, trial” and insert -- normal --, therefor.

Signed and Sealed this
Thirtieth Day of September, 2014

Michelle K. Lee

Michelle K. Lee
*Deputy Director of the United States Patent and Trademark Office*